US007645488B2

(12) United States Patent
Hotz et al.

(10) Patent No.: US 7,645,488 B2
(45) Date of Patent: Jan. 12, 2010

(54) METHOD FOR PRODUCING SHAPED ALUMINIUM SHEETS WITH A DECORATIVE FINISH

(75) Inventors: Walter Hotz, Beringen (CH); Volkmar Gillich, Neuhausen am Rheinfall (CH); Roman Fuchs, Neuhausen am Rheinfall (CH)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 296 days.

(21) Appl. No.: 11/660,773

(22) PCT Filed: Sep. 8, 2004

(86) PCT No.: PCT/EP2004/010010

§ 371 (c)(1),
(2), (4) Date: May 14, 2007

(87) PCT Pub. No.: WO2006/027007

PCT Pub. Date: Mar. 16, 2006

(65) Prior Publication Data

US 2008/0008833 A1 Jan. 10, 2008

(51) Int. Cl.
*B05D 1/38* (2006.01)

(52) U.S. Cl. ..... 427/387; 427/388.1; 427/388.4; 427/388.5; 427/409

(58) Field of Classification Search ..... None
See application file for complete search history.

(56) References Cited

U.S. PATENT DOCUMENTS 5,750,197 A * 5/1998 van Ooij et al. ..... 427/308
6,848,797 B1 2/2005 Gillich et al.
7,182,475 B2 2/2007 Kramer et al.
2004/0062873 A1 * 4/2004 Jung et al. ..... 427/407.1
2004/0233530 A1 11/2004 Kramer et al.

FOREIGN PATENT DOCUMENTS

CH 691 064 4/2001
EP 1 457 266 9/2004

* cited by examiner

*Primary Examiner*—Erma Cameron
(74) *Attorney, Agent, or Firm*—Bachman & LaPointe, P.C.

(57) ABSTRACT

A method for producing weather- and corrosion-resistant shaped sheets consisting of aluminum or an aluminum alloy with a decorative finish in a coil coating process that comprises the following sequential steps: an aluminum strip or aluminum alloy strip is provided; optional continuous degreasing of the strip; optional electrochemical, chemical or mechanical burnishing of the optionally degreased strip; the optionally degreased and/or burnished strip is continuously pre-treated to create a pre-treated layer that is suitable for use as an adhesive base for a paint layer; the optionally degreased strip is continuously pre-treated to create a strip surface that is suitable for use as an adhesive base for a paint layer; the pre-treated strip is continuously painted with a sol-gel paint consisting of a polysiloxane to create a first protect protective layer; the first protective layer is continuously dried and cured in a continuous furnace; the sheets are produced by shaping the strip that comprises the first protective layer and cutting the sheets that are optionally to be further shaped, or by cutting the sheets out of the strip that comprises the first protective layer and shaping the cut sheets; the shaped sheets are painted with a sol-gel paint consisting of a polysiloxane to create a second protective layer and the second protective layer is dried and cured in a furnace. The shaped parts that are produced by the method are characterized by excellent weather- corrosion- and abrasion resistance.

18 Claims, No Drawings

METHOD FOR PRODUCING SHAPED ALUMINIUM SHEETS WITH A DECORATIVE FINISH

BACKGROUND OF THE INVENTION

The invention concerns a method for the production of weather- and corrosion-resistant formed metal parts of aluminium or an aluminium alloy with decorative surface.

In the production of decorative formed parts of aluminium such as e.g. trim strips, in a conventional method the parts are first punched out of a strip and formed. The pre-treatment and application of further surface coatings are performed on the already formed parts. This procedure is very costly and associated with complex handling, as the metal parts to be treated in different baths are placed on holders and must often be transferred from one holder to another.

EP-A-1 154 289 discloses a coil coating process for production of reflector plates of aluminium or an aluminium alloy. However, the protective coating on the reflector plates which are produced with this method has a tendency to form cracks when the plates are formed so that the weather- and corrosion-resistance of the formed metal parts is no longer guaranteed.

The invention is based on the object of creating a method for production of formed metal parts of aluminium or an aluminium alloy with decorative surface using a coil coating process with better weather- and corrosion-resistance than known processes.

SUMMARY OF THE INVENTION

The solution according to the invention leads to a method which comprises in succession the following steps:

provision of a strip of aluminium or an aluminium alloy, where applicable continuous degreasing of the strip, where applicable electrochemical, chemical or mechanical polishing of the degreased strip, continuous pre-treatment of the degreased and/or polished strip to produce a pre-treatment coating which is suitable as an adhesion base for a lacquer coating, continuous lacquering of the pretreated strip with a sol-gel lacquer of polysiloxane to generate a first protective coating, continuous drying and hardening of the first protective coating in a belt oven, production of the metal parts by a. forming the strip with the first protective coating and trimming the metal parts that may be formed further, or b. cutting the metal parts out of the strip with the first protective coating and forming of the cut metal parts, lacquering of the formed metal parts with a sol-gel lacquer of a polysiloxane to generate a second protective coating, drying and hardening of the second protective coating in an oven.

DETAILED DESCRIPTION

The layer thickness of the hardened sol-gel lacquer of the first protective coating is preferably at least 1 μm and preferably between 1 and 1.5 μm, in particular between 1 and 3 μm. If the sol-gel lacquer also contains dye pigments, the layer thickness can be up to 10 μm.

The layer thickness of the hardened sol-gel lacquer of the second protective coating is preferably at least 0.5 μm and preferably between 1 and 3 μm.

Generation of a second protective coating on the surface of the formed metal parts leads to the desired weather- and corrosion-resistance.

The sol-gel lacquer preferably comprises a polysiloxane made from an alcoholic silane solution, preferably an alkoxysilane solution, and a watery colloidal silicic acid solution, and in particular comprises cross-linked inorganic polysiloxanes with organic groups, in particular alkyl groups, bonded to the silicon by way of carbon bonds. Polysiloxane is a term for polymers of cross-linked siloxanes.

The strip material for production of the formed parts can be conventional aluminium with a purity of 98.3% or higher, depending on the requirements imposed on surface quality, e.g. aluminium with a purity of 99.0% and higher, where applicable also with a purity of 99.5%. In particular cases a purity of 99.8% and higher may be indicated. As well as aluminium of the said purities, aluminium alloys can also be used. Preferred alloys are those of series AA 1000, AA 3000 and AA 5000. Further possible alloys contain for example 0.25 to 5 w. %, in particular 0.5 to 4 w. % magnesium, or 0.2 to 2 w. % manganese, or 0.5 to 5 w. % magnesium and 0.2 to 2 w. % manganese, in particular 1 w. % magnesium and 0.5 w. % manganese, or 0.1 to 12 w. %, preferably 0.1 to 5 w. % copper, or 0.5 to 6 w. % zinc and 0.5 to 5 w. % magnesium, or 0.5 to 6 w. % zinc, 0.5 to 5 w. % magnesium and 0.5 to 5 w. % copper, 0.5 to 2 w. % iron and 0.2 to 2 w. % manganese, in particular 1.5 w. % iron and 0.4 w. % manganese, or AlMgSi or AlFeSi alloys. Further examples are AlMgCu alloys, such as AlMg0.8Cu or AlMg alloys such as AlMgl or AlFeMn alloys such as AlFeMn1.5.

The metal parts can be formed for example by bending, deep drawing, cold extrusion or roll forming, but also by other forming methods.

The pre-treatment layer can for example be a coating which is produced by chromatisation, phosphatisation or anodic oxidation. Preferably the pre-treatment layer is made of anodically oxidised aluminium.

The pre-treatment layer can have a thickness of for example at least 10 nm, preferably at least 20 nm, in particular at least 50 nm and advantageously at least 100 nm. The maximum thickness of the pre-treatment layer is for example 5000 nm, preferably 1500 nm and in particular 300 nm.

The pre-treatment layer is preferably an anodically generated oxide layer which is constructed in a non-redissolving or redissolving electrolyte. The pre-treatment layer is preferably a porous anodically generated oxide layer.

Anodisation preferably takes place in an acid electrolyte from the series of phosphoric acid, citric acid, tartaric acid, chromic acid electrolyte and in particular the series of sulphuric acid electrolytes. Anodisation takes place in AC or DC methods.

The pre-treatment layer can also be a yellow chromate coating, a green chromate coating, a phosphate coating or a chromium-free pre-treatment layer which is formed in an electrolyte containing at least one of the elements Ti, Zr, F, Mo or Mn.

Furthermore, the aluminium surface for pre-treatment can be polished in a chemical or electrochemical method or subjected to an alkali pickling process. Such polishing or pickling processes are performed before anodisation.

Before application of the pre-treatment layer or performance of a first pre-treatment step, the strip surface is suitably de-greased and cleaned. Pre-treatment can also comprise solely degreasing and cleaning of the strip surface. The strip surface can be cleaned in a known manner e.g. chemically and/or electrochemically and by acid or alkali. Its purpose is the removal of foreign substances and where applicable the naturally occurring oxide layer on the aluminium surface. Suitable cleaning agents are e.g. acid, watery degreasant, alkali degreasant based on polyphosphate and borate. Cleaning with moderate to severe material removal is achieved by pickling or etching by means of strong alkali or acid pickling solutions, such as e.g. caustic soda lye or a mixture of nitric acid and hydrochloric acid. The existing oxide layer and its contaminants are removed. With highly aggressive alkali pickling, where applicable acid post-treatment may be required.

The strip surface can also be cleaned using known electrochemical, chemical or mechanical polishing methods. The polishing process can also influence the optical appearance of the strip surface on the end product.

As part of the method according to the invention, in a preferred embodiment the pre-treatment layer can for example be applied to the aluminium strip while observing the following process conditions:

a) degreasing at pH 9-9.5 at around 50° C., b) rinsing with tap water (room temperature), c) electrochemical polishing d) rinsing with tap water (room temperature), e) anodising in 20% $H_2SO_4$ at around 25° C. and 20V voltage, f) rinsing in tap water at around 50° C. and g) rinsing in de-ionised water at around 85° C.

The aluminium strip passes continuously through the various treatment baths with a speed for example of 40 m/min.

The protective coating and where applicable further coatings can then be applied to the pre-treatment layer.

The sol-gel lacquer which is applied to the pre-treatment layer is preferably a polysiloxane made from alcoholic silane solution, in particular an alkoxysilane solution, and a colloidal silicic acid solution. The polysiloxane is produced in particular by a condensation reaction between hydrolysed and cross-linked silanes, in particular alkoxysilanes, and colloidal silicic acid.

The condensation reaction between hydrolysed silanes, in particular alkoxysilanes, and between hydrolysed silanes, in particular alkoxysilanes, and colloidal silicic acid, leads to the formation of an inorganic network of polysiloxanes. At the same time, organic groups, in particular alkyl groups or simple alkyl groups, are integrated into the inorganic network by way of carbon bonds. The organic groups or alkyl groups do not however participate directly in the polymerisation or cross-linking of the siloxanes, i.e. they do not serve to form an organic polymer system but merely for functionalisation. The function lies in the fact that the organic groups, in particular the alkyl groups, are attached to the outsides of the polysiloxanes during the sol-gel process and hence form a layer which is water-repellent towards the outside, which gives the sol-gel lacquer a pronounced hydrophobic property.

The sol-gel process described, as stated, leads by targeted hydrolysis and condensation of alkoxides of silicon and silicic acid to a sol-gel lacquer from an inorganic network with integral alkyl groups. The resulting polysiloxanes should therefore rather be allocated to the inorganic polymers.

In the production of a preferred embodiment of a sol-gel lacquer as a protective coating, suitably two base solutions A and B are used.

Solution A is an alcoholic solution of one or more different alkoxysilanes, wherein the alkoxysilanes are present in non-hydrolysed form in a water-free medium. As a suitable solvent an alcohol is used such as for example methyl, ethyl, propyl or butyl alcohol and preferably isopropyl alcohol.

The alkoxysilanes are described by the general formula $X_nSi(OR)_{4-n}$, in which "R" is a simple alkyl, preferably from the group comprising methyl, ethyl, propyl and butyl. "X" is suitably also an alkyl, preferably from the group comprising methyl, ethyl, propyl and butyl. Suitable alkoxysilanes are for example tetramethoxysilane (TMOS) and preferably tetraethoxysilane (TEOS) and methyltrimethoxysilane (MTMOS) and further alkoxysilanes.

In a particularly preferred embodiment, solution A is prepared from tetraethoxysilane (TEOS) and/or methyltrimethoxysilane (MTMOS) with a methyl, ethyl or propyl alcohol, and in particular with an isopropyl alcohol as solvent. Solution A can e.g. comprise 25-35 w. %, in particular 30 w. % TEOS and 15-25 w. %, in particular 20 w. % MTMOS, both dissolved in 40-60 w. %, in particular 50 w. % isopropyl alcohol.

Solution B contains colloidal silicic acid dissolved in water. In a suitable embodiment solution B is set by means of acid, preferably by means of nitric acid ($HNO_3$) to a pH value between 2.0-4, preferably between 2.5-3.0 and in particular to 2.7.

The silicic acid used is suitably silicic acid which is stabilised in an acid environment, wherein the pH value of the silicic acid is advantageously 2-4. The silicic acid is advantageously as low-alkali as possible. The alkali content (e.g. $Na_2O$) of the silicic acid is preferably below 0.04 w. %.

Solution B contains for example 70-80 w. %, in particular 75 w. %, water as solvent and 20-30 w. %, in particular 25 w %, colloidal silicic acid. Solution B is preferably set by nitric acid ($HNO_3$) to a pH value between 2.0-3.5, preferably between 2.5-3.0 and in particular to 2.7. A preferred silicic acid solution is sold for example by the company Nissan Chemical Industries Ltd. under the product name "SNOWTEX® O".

The merging and mixing of the two base solutions A and B leads, in the presence of nitric acid, to a hydrolysis reaction between the water contained in solution B and the alkoxysilanes contained in solution A.

Hydrolysis reaction: $Si(OR)_n + nH_2O \rightarrow Si(OH)_n + nR(OH)$

At the same time a condensation reaction occurs in which under water elimination from two Si—OH groups in each case, a siloxane bond (Si—O—Si) is formed. Progressive polymerisation leads to a network of polyoxysilanes on which are attached alkyl groups. The new mixed solution is present in a gel-like state. The two solutions A and B are preferably mixed in a weight ratio of 7:3 parts.

The sol-gel lacquer is suitably applied to the surface of the aluminium strip in gel form and then dried or hardened.

The continuous coating to produce the first protective layer takes place in a coil coating process. A typical coil coating process is a roll application process with two or three rolls.

The drying process comprises expelling the water and alcohols remaining in the sol-gel lacquer, whereby the sol-gel lacquer hardens and a weather-resistant and corrosion-resistant protective coating is produced on the strip surface.

The strip which is coated with the sol-gel lacquer is suitably dried or hardened by means of radiation, such as UV radiation, electron radiation, laser radiation, or by means of thermal radiation such as IR radiation, or by means of convection heating or a combination of the said drying or hardening methods.

The temperature measured on the strip surface for drying or hardening of the sol-gel lacquer is suitably more than 60° C., preferably more than 150° C. and in particular more than 200° C. The increased temperature is furthermore suitably less than 400° C., preferably less than 350° C. and in particular less than 300° C. The temperature particularly preferably lies between 250° C. and 300° C. The temperatures given are so-called "peak metal temperatures" (PMT).

The increased temperature can for example act on the strip for between 5 seconds and 2 minutes. The sol-gel lacquer is dried or hardened for a period of preferably less than 90 seconds, in particular less than 60 seconds, and preferably more than 10 seconds, in particular more than 30 seconds. On use of IR radiation, the drying times lie rather in the lower range of the given durations.

Convection heating can suitably take place by exposure to warmed gases such as air, nitrogen, noble gases or mixtures thereof. The sol-gel lacquer coating is dried in a belt oven.

The strip with the first protective coating is suitably processed further by roll forming, the metal parts are cut off and where applicable subjected to a further forming step. In a variant of the process, first metal parts are cut or punched from the strip with the first protective coating and then the cut metal parts are formed.

The formed metal parts are then lacquered with a sol-gel lacquer of polysiloxane to generate the second protective coating and transferred to an oven to dry and harden the second protective coating. Preferably the second protective coating is also dried or hardened in a belt oven.

The lacquer can be applied in any method. Spray lacquering is preferred.

The drying and hardening of the second protective coating preferably take place under the same process conditions as the drying and hardening of the first protective coating described above.

The formed parts which are produced with the method according to the invention, thanks to the hard protective coating with pronounced adhesion, have a good protective effect against weather influences, corrosion and mechanical abrasion, and are characterised by good UV resistance.

The formed parts which are produced according to the invention, thanks to the sol-gel protective coating of polysiloxanes, have a high surface hardness. The sol-gel protective coating suitably has a hardness, measured on the "Pencil method of Wolf Wilbum" to DIN 55350 Part 18, of greater than "f", preferably greater than "h", in particular greater than "2h" and advantageously greater than "3h", where greater means harder.

The sol-gel layer is characterised also by a pronounced adhesion to the formed metal parts.

With reference to an example, the preparation and production of a particularly preferred embodiment of a sol-gel lacquer is described below. Solution A and solution B are prepared for this.

Solution A contains:

| | |
|---|---|
| 50 w. % | isopropyl alcohol |
| 30 w. % | tetraethoxysilane (TEOS) |
| 20 w. % | methyltrimethoxysilane (MTMOS) |

Solution B contains:

| | |
|---|---|
| 75 w. % | water |
| 25 w. % | colloidal silicic acid |

The pH value of solution B is set to approx. 2.7 by the addition of an acid, in particular nitric acid ($HNO_3$).

The production of the sol-gel lacquer and the coating of the aluminium strip in a preferred embodiment take place as follows:

A base solution A as described above is mixed in a proportion of 70 w. % of the mixed solution, under agitation, with a solution B in a proportion of 30 w. % of the mixed solution. Solutions A and B are transferred under continuous agitation to a mixed solution, wherein due to reaction heat is released.

The mixed solution is agitated for a particular time, for example 1 h to 10 h, preferably 4 to 8 h, in particular for around 6 h. The mixture is then-filtered. The filter serves to retain larger particles, e.g. particles of colloidal[1] silicic acid. The pore diameter or mesh width of the filter depends on the desired layer thickness, as particles of larger diameter than the targeted layer thickness reduce the surface quality of the protective coating. The filtration can for example take place by means of a polypropylene filter with a porosity of 1 μm.

The mixed solution is suitably set to a pH value of 2-4, preferably 2-3.5, in particular 2.5-3, and particularly preferably 2.7. The pH value is adjusted by means of acid, preferably nitric acid.

After conclusion of the agitation process, the sol-gel lacquer can be applied to the strip surface by means of one of the above-mentioned methods and then, as described initially, dried or hardened.

In an advantageous embodiment of the production method, the sol-gel lacquer, after production and before application to the strip surface, is left to rest for a few minutes to several hours, preferably between 1 and 24 h, in particular between 12 and 22 h and particularly preferably for around 17 h.

The element analysis of the hardened sol-gel lacquer by means of XPS (X-ray Photoelectron Spectroscopy) shows e.g. the elements oxygen, silicon and around 5-20 at. % (atomic percentage) carbon.

The invention claimed is:

1. Method for production of weather- and corrosion-resistant formed metal parts of aluminum or an aluminum alloy with decorative surface using a coil coating process, comprising the steps of:

(a) providing a strip of aluminium or an aluminium alloy, (b) optionally continuous degreasing of the strip, (c) optionally electrochemical, chemical or mechanical polishing of the degreased strip, (d) continuous pre-treatment of the optionally degreased and/or polished strip to produce a pre-treatment coating which is suitable as an adhesion base for a lacquer coating, (e) continuous lacquering of the pretreated strip with a sol-gel lacquer of polysiloxane to generate a first protective coating (f) continuous drying and hardening of the first protective coating in a belt oven, (g) forming metal parts from the strip by (1) shaping the strip with the first protective coating and trimming, or (2) cutting metal parts out of the strip with the first protective coating and shaping of the cut metal parts, (h) lacquering the formed metal parts with a further sol-gel lacquer of a polysiloxane to generate a second protective coating, and (i) drying and hardening of the second protective coating in an oven.

2. Method according to claim 1, wherein the thickness of the first protective coating is at least 1 μm.

3. Method according to claim 1, wherein the thickness of the first protective coating is between 1 and 10 μm.

4. Method according to claim 1, wherein the thickness of the first protective coating is between 1 and 4.5 μm.

5. Method according to claim 1, wherein the thickness of the first protective coating is between 1 and 3 μm.

6. Method according to claim 2, wherein the thickness of the second protective coating is at least 0.5 μm.

7. Method according to claim 2, wherein the thickness of the second protective coating is between 0.5 and 3 μm.

8. Method according to claim 1, wherein both of the sol-gel lacquers are a polysiloxane comprising an alcoholic silane solution.

9. Method according to claim 1, wherein both of the sol-gel lacquers are a polysiloxane comprising an alkoxysilane, and a watery colloidal silicic acid solution.

10. Method according to claim 1, wherein both of the sol-gel lacquers comprise cross-linked inorganic polysiloxanes with organic groups.

11. Method according to claim 1, wherein both of the sol-gel lacquers comprise alkyl groups, bonded to the silicon by way of carbon bonds.

12. Method according to claim 1, wherein the strip is a bright material or a material with a matt decorative surface.

13. Method according to claim 1, wherein a pre-treatment coating comprising an anodic oxide layer is produced on the strip surface.

14. Method according to claim 13, wherein the anodic oxide layer is dyed.

15. Method according to claim 1, wherein a pre-treatment coating comprising a chromate layer is produced on the strip surface.

16. Method according to claim 1, wherein a pre-treatment coating comprising a chromium-free layer is produced on the strip surface.

17. Method according to claim 1, wherein both of the sol-gel lacquers contain dye pigments.

18. Method according to claim 1, wherein the formed metal parts are used as decorative parts in automobile construction.

* * * * *